US007207325B2

(12) United States Patent
Ando

(10) Patent No.: US 7,207,325 B2
(45) Date of Patent: Apr. 24, 2007

(54) ENGINE IGNITION SYSTEM HAVING NOISE PROTECTION CIRCUIT

(75) Inventor: Koji Ando, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/194,477

(22) Filed: Aug. 2, 2005

(65) Prior Publication Data

US 2006/0027219 A1 Feb. 9, 2006

(30) Foreign Application Priority Data

Aug. 6, 2004 (JP) ..... 2004-230895

(51) Int. Cl.
*F02P 3/05* (2006.01)
*F02P 3/055* (2006.01)

(52) U.S. Cl. ..... 123/618; 123/651

(58) Field of Classification Search ..... 123/618, 123/651, 644, 650; 315/209 T; 361/91.1, 361/91.5, 91.6
See application file for complete search history.

(56) References Cited

U.S. PATENT DOCUMENTS 3,908,622 A * 9/1975 Long ..... 123/595
5,483,093 A 1/1996 Murakami
5,668,384 A 9/1997 Murakami
6,614,633 B1 * 9/2003 Kohno ..... 361/56
6,848,437 B2 * 2/2005 Naruse et al. ..... 123/644
2004/0000299 A1 * 1/2004 Naruse et al. ..... 123/644

* cited by examiner

*Primary Examiner*—Mahmoud Gimie
(74) *Attorney, Agent, or Firm*—Nixon & Vanderhye PC

(57) ABSTRACT

An ignition system for an internal combustion engine includes a switch circuit connected to an ignition coil to switch on or off current supplied to the ignition coil, a control circuit for providing a control signal for controlling the switch circuit based on the ignition signal and a protection circuit including an input terminal that receives the ignition signal, an NPN transistor having a collector connected to the input terminal, an emitter connected to a ground, a base and the collector and a parasitic diode between the collector and the emitter of the NPN transistor, in which a prescribed capacitance is formed between the base and the collector of the NPN transistor. If an electric surge that has an ascending slope comes into the input terminal, the NPN transistor to turn on to discharge the electric surge to a ground. If an electric surge that has an descending slope comes into the input terminal, it passes through the parasitic diode toward the input terminal.

13 Claims, 8 Drawing Sheets

ENGINE IGNITION SYSTEM HAVING NOISE PROTECTION CIRCUIT

CROSS REFERENCE TO RELATED APPLICATION

The present application is based on and claims priority from Japanese Patent Application 2004-230895, filed Aug. 6, 2004, the contents of which are incorporated herein by reference.

BACKGROUND OF THE INVENTION

1. Field of the Invention

The present invention relates to an ignition system for an internal combustion engine and, more particularly, an electronically controlled ignition system that includes a power switching element, an integrated control circuit (IC) and a protection circuit that protects the ignition system from extraneous electric surges.

2. Description of the Related Art

U.S. Pat. Nos. 5,483,093 and 5,668,384, which are based on JP-A-Hei 5-22099, disclose an ignition system that includes a power switching element, a control IC and a zener diode that protects the control IC from electric surges. The zener diode has a cathode connected to the input terminal of the control IC and an anode connected to a ground (GND). If a high frequency noise comes to the control IC, the zener diode removes it by its capacitance and voltage clamping function.

However, in order to substantially remove such high frequency noises that include noises of frequencies between 0.1 MHz and several tens of MHz, a discrete capacitor having much larger capacitor is necessary. Such a discrete capacitor increases the size and cost of the ignition system.

SUMMARY OF THE INVENTION

Therefore, a main object of the invention is to provide a compact ignition system that includes an electric surge protection circuit.

According to a feature of the invention, an ignition system for an internal combustion engine includes a switch circuit connected to the ignition coil to switch on or off current supplied to an ignition coil, a control circuit for providing a control signal to control the switch circuit based on the ignition signal and a protection circuit having an input terminal that receives the ignition signal, a first NPN transistor having a collector connected to the input terminal, an emitter connected to a ground, a base and a parasitic diode between the collector and the emitter, in which a prescribed capacitance is formed between the base and the collector of the first NPN transistor. Because the capacitance is formed between the base and the collector of the NPN transistor, the capacitance can be made very small. For example, about 1/100 (inverse proportion of the gain of the transistor) of the capacitance of a zener diode or a discrete capacitor connected between the input terminal of the control IC and a ground. That is, the capacitance may be between 0.1 nF and 0.01 nF.

If an electric surge that has an ascending slope comes into the input terminal, the NPN transistor turns on to discharge the electric surge to a ground. On the other hand, an electric surge passes through the parasitic diode toward the input terminal if it has an descending slope. Therefore, the ignition system can be substantially protected from extraneous electric surges without a large discrete capacitor.

According to another feature of the invention, an ignition system for an internal combustion engine includes a switch circuit connected to an ignition coil to switch on or off current supplied to the ignition coil, a control circuit for providing a control signal to control the switch circuit based on the ignition signal and a protection circuit including an input terminal that receives the ignition signal, a first NPN transistor having a collector connected to the input terminal, an emitter, a base and a parasitic diode between the collector and the emitter and a second NPN transistor having a base connected to the collector of the first NPN transistor, a collector connected to the input terminal, thereby forming a Darlington circuit so as to increase the current gain of the protection circuit, in which a prescribed capacitance is formed between the base and the collector of the first NPN transistor. This feature increases the current gain of the protection circuit in addition to the function stated above.

In the above stated ignition system, the prescribed capacitance may be provided by a small capacitor connected between the base and the collector of the first NPN transistor. The prescribed capacitance may be formed at a junction of a zener diode that has an anode connected to the base and a cathode connected to the collector of the first NPN transistor or formed between the base and the collector of the first NPN transistor. The control circuit may include a wave-form shaping circuit for shaping the ignition signal and a gate driving circuit for providing a driving signal from the signal shaped by the wave-form shaping circuit.

The ignition system as described above may further include an ESD (electro static discharge) prevention element connected between the input terminal and a ground. The ESD prevention element may include a pair of zener diodes connected back-to-back each other.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
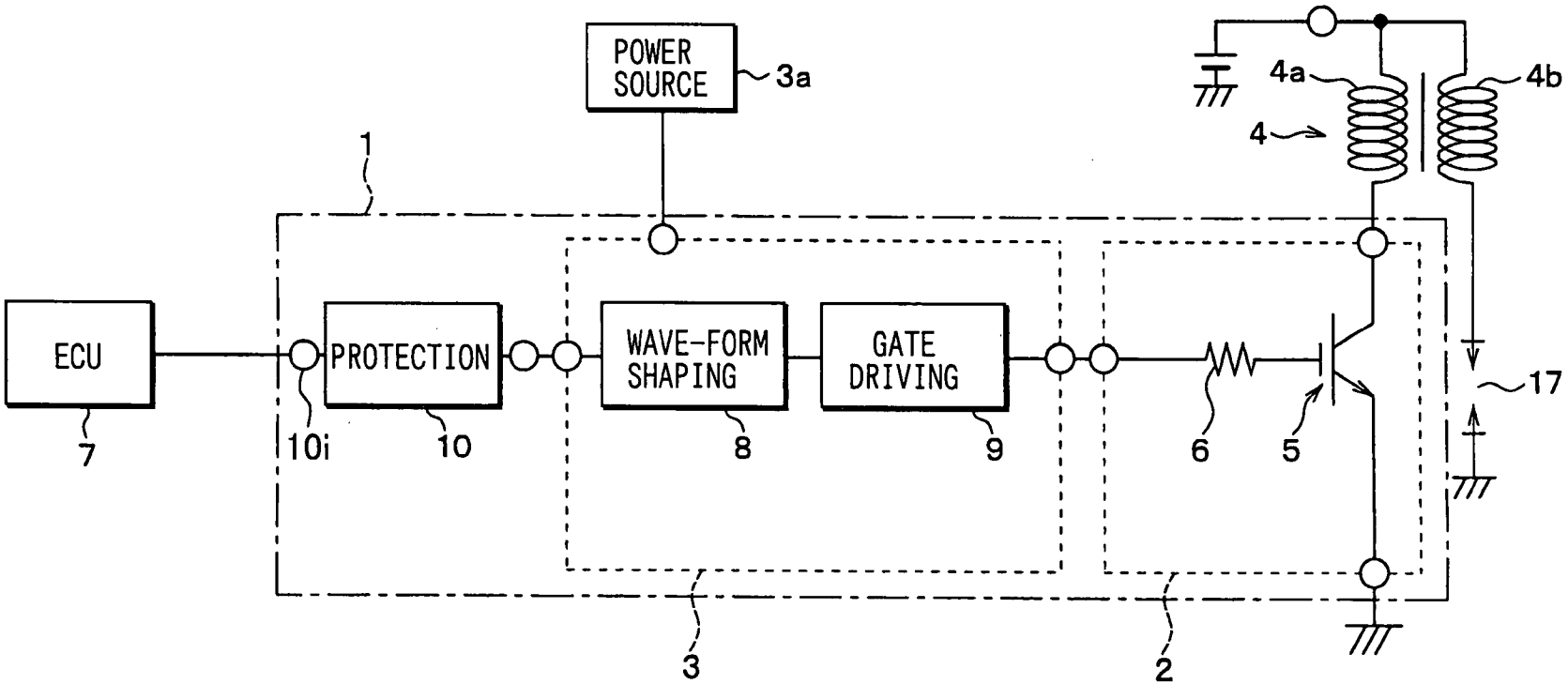
FIG. 1 is a circuit diagram of an ignition system according to the first embodiment of the invention.

An ignition system 1 for an internal combustion engine according to the first embodiment of the invention will be described with reference to FIGS. 1–3. The ignition system 1 according to the first embodiment includes an integrated switching circuit (hereinafter referred to as the switch IC) 2 and an integrated control circuit (hereinafter referred to as the control IC) 3 and a protection circuit 10. The ignition system 1 is connected to an ignition coil 4 that supplies an ignition spark to a spark plug 17. The ignition coil 4 includes a primary coil 4*a* connected to the switch IC 2 and a secondary coil 4*b* connected to the spark plug 17.

The switch IC 2 and the control IC 3 are formed on separate chips that are connected to each other by wires. The switch IC 2 includes an insulated gate bipolar transistor (hereinafter referred to the IGBT) 5 and an input resistor 6 to switch on or off electric current supplied to the primary coil 4*a* of the ignition coil 4. The IGBT 5 has a collector connected to the primary coil of the ignition coil 4, an emitter connected to a ground and a base connected to the input resistor 6. The input resistor 6 is a resistor to limit input current flowing through the gate of the IGBT 5.

When a high level gate voltage is supplied by the control IC 3 to the gate of the IGBT 5 through the series resistor 6, the IGBT 5 turns on to supply electric current to the primary coil 4*a*. The IGBT turns off to cut the electric current when a low level gate voltage is supplied by the control IC 3 to the gate of the IGBT 5.

The control IC 3 forms the gate voltage to control the IGBT 5 from an ignition signal that is sent from an engine control unit (hereinafter referred to as the engine ECU) 7. The control IC 3 is powered by a electric power source 3*a*. The control IC 3 includes a wave-form shaping circuit 8 and a gate driving circuit 9. The wave form of the ignition signal that is sent to the control IC 3 is shaped by the wave-form shaping circuit 8. Then the ignition signal is converted by the gate driving circuit 9 into high or low level gate driving signal to be applied to the gate of the IGBT 5.

Figure 2:
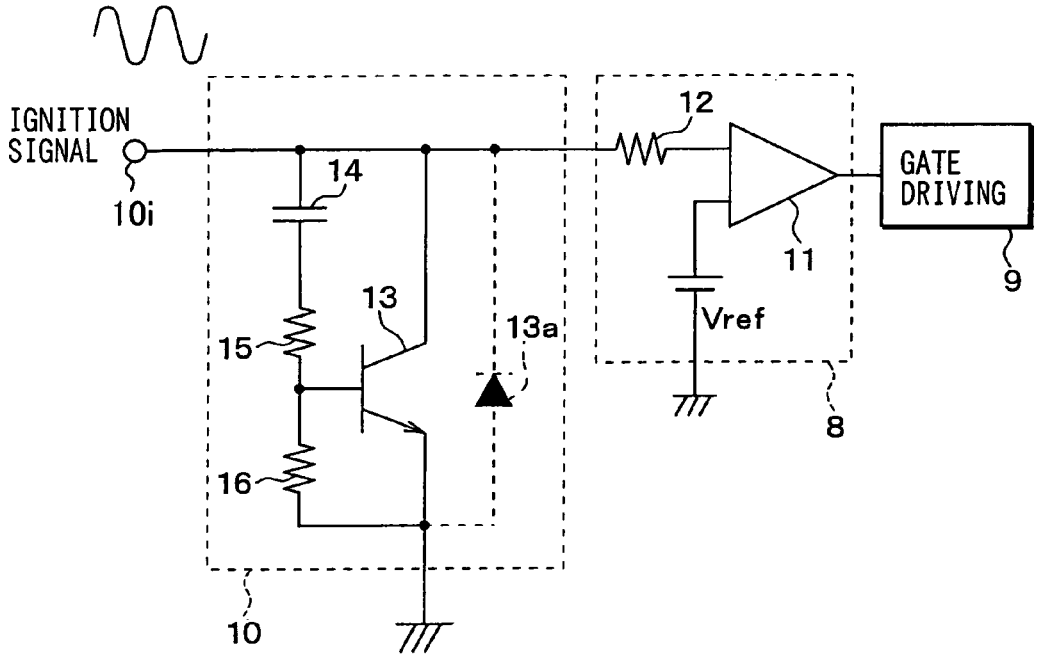
FIG. 2 is a circuit diagram of a protection element and a control IC of the ignition system according to the first embodiment.

As shown in FIG. 2, the wave-form shaping circuit 8 includes a comparator 11 that has a non-inverting input terminal connected to a resistor 12 and an inverting input terminal connected to a source of reference voltage Vref. The protection circuit 10 is connected to the input terminal of the wave-form shaping circuit 8.

The protection circuit 10 is formed in a semiconductor chip, which includes an ignition signal input terminal 10*i*, an NPN transistor 13, a capacitor 14, a first resistor 15 and a second resistor 16. The NPN transistor 13 has a collector connected to the ignition signal input terminal 10*i*, an emitter connected to a ground and a base. The capacitor 14 and the resistor 15 are connected in series to connect the input terminal 10*i* and the base of the NPN transistor 13. The second resistor 16 is connected between the base and the emitter of the NPN transistor 13.

When the ECU 7 provides a high level ignition signal whose voltage level is higher than the reference voltage Vref, the comparator 11 provides a high level signal, which makes the gate driving circuit 9 turn on the IGBT 5. Accordingly, current supplied to the primary coil 4*a* of the ignition coil 4 gradually increases to a prescribed amount. When the ECU provides a low level ignition signal whose voltage level is lower than the reference voltage Vref, the comparator 11 provides a low level signal, which makes the gate driving circuit 9 turn off the IGBT 5. Accordingly, current supplied to the primary coil 4*a* of the ignition coil 4 is cut off, so that a high tension voltage is generated by the secondary coil 4*b* to cause an electric spark at the spark plug 17.

If an electric surge that has an ascending slope (positive slope) comes into the ignition signal input 10*i*, it biases the base of the NPN transistor 13 to turn on. Accordingly, the electric surge is discharged to the ground through the collector-emitter path of the transistor 13.

Figure 3A:
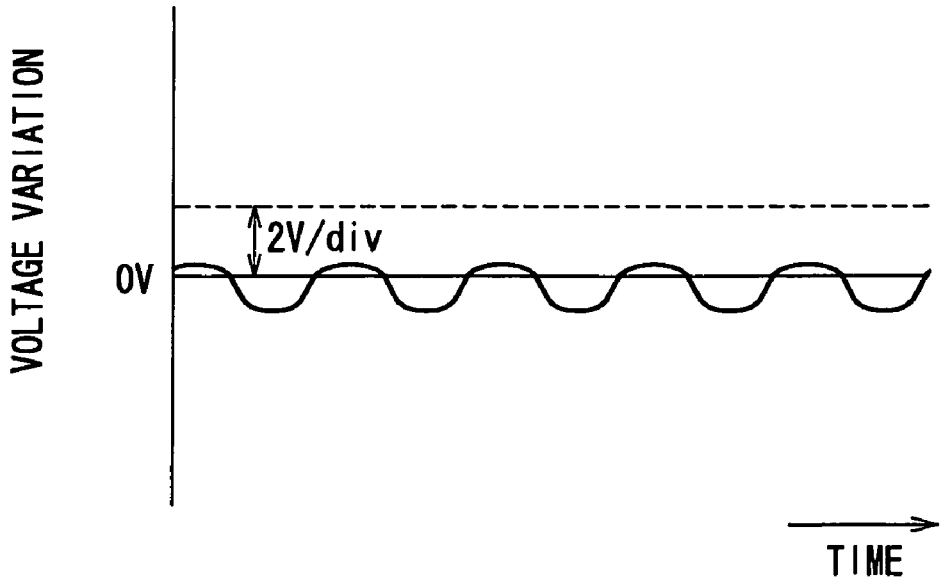
FIG. 3A is a graph showing a voltage wave appearing on an input terminal of the ignition system according to the first embodiment.
Figure 3B:
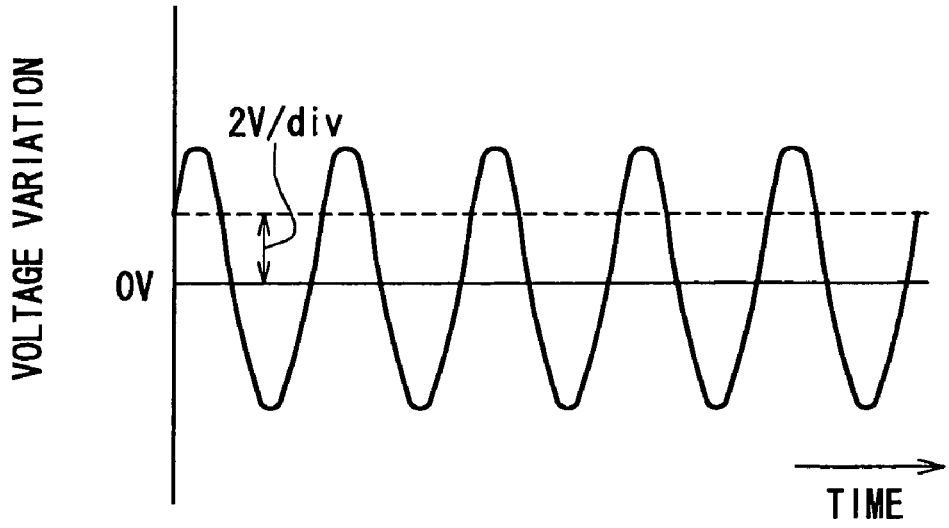
FIG. 3B PRIOR ART
FIG. 3B is a graph showing a voltage wave appearing on an input terminal of an ignition system without surge protection.

If an electric surge that has an descending slope (negative slope) comes into the ignition signal input 10*i*, it passes through a parasitic diode 13*a* toward the ignition signal input 10*i*. Accordingly, the electric surge does not cause a substantial voltage variation of the control IC 3, as shown in FIG. 3A in comparison with FIG. 3B.

Thus, additional discrete capacity is not necessary to protect the control IC 3 from electric surges. That is, the NPN transistor 13, the capacity 14 and the resistor 15 can be integrated into a semiconductor chip. Although the normal ignition signal has an ascending slope to bias the base of the NPN transistor 13 to turn on, the NPN transistor 13 timely turns off thereafter, because of the characteristic of the normal ignition signal.

Figure 4:
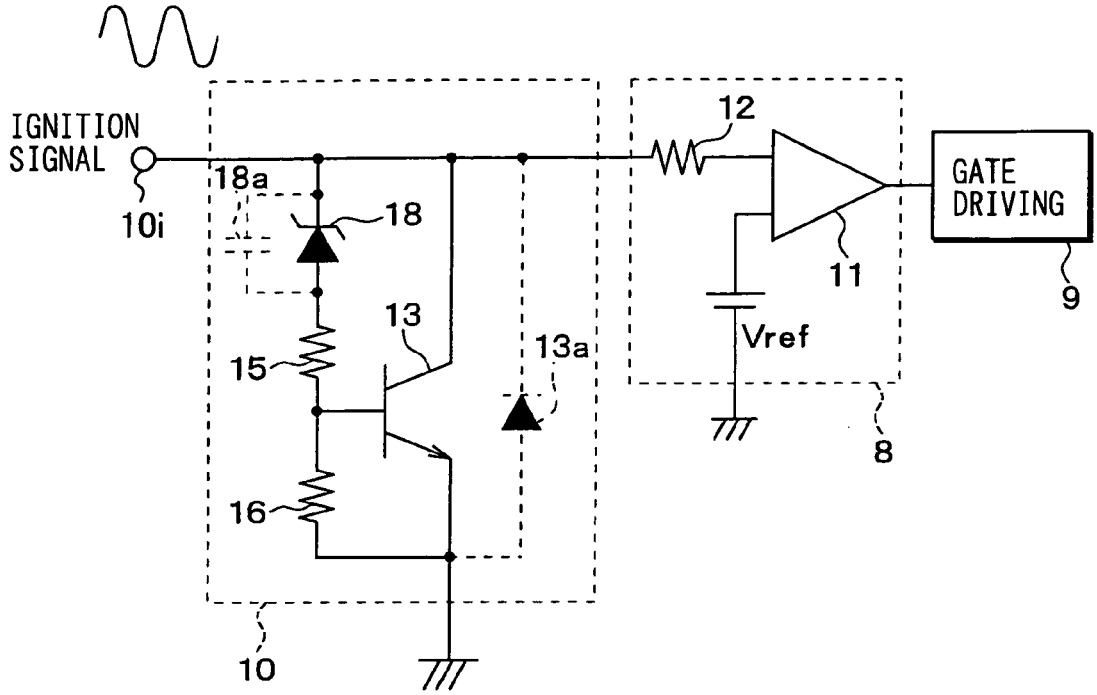
FIG. 4 is a circuit diagram of a protection element and a control IC of the ignition system according to the second embodiment of the invention.

An ignition system 1 for an internal combustion engine according to the second embodiment of the invention will be described with reference to FIG. 4.

Incidentally, the same reference numeral in the following description of the embodiments corresponds to the same or substantially the same part component or portion as that of the preceding embodiment.

The capacitor 14 of the first embodiment is replaced with a zener diode 18, because the zener diode has a parasitic capacitor that functions as the capacitor 14 of the first embodiment.

Figure 5:
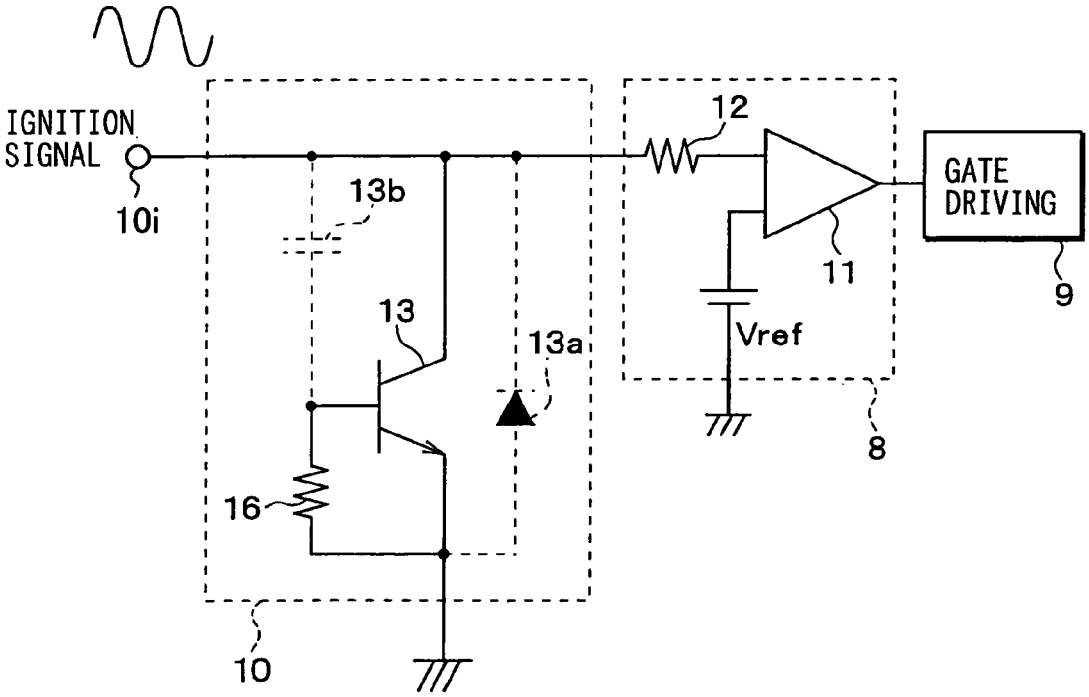
FIG. 5 is a circuit diagram of a protection element and a control IC of the ignition system according to the third embodiment of the invention.

An ignition system 1 for an internal combustion engine according to the third embodiment of the invention will be described with reference to FIG. 5. The capacitor 14 of the first embodiment is omitted, because the NPN transistor 13 has a parasitic capacitor that functions as the capacitor 14 of the first embodiment.

Figure 6:
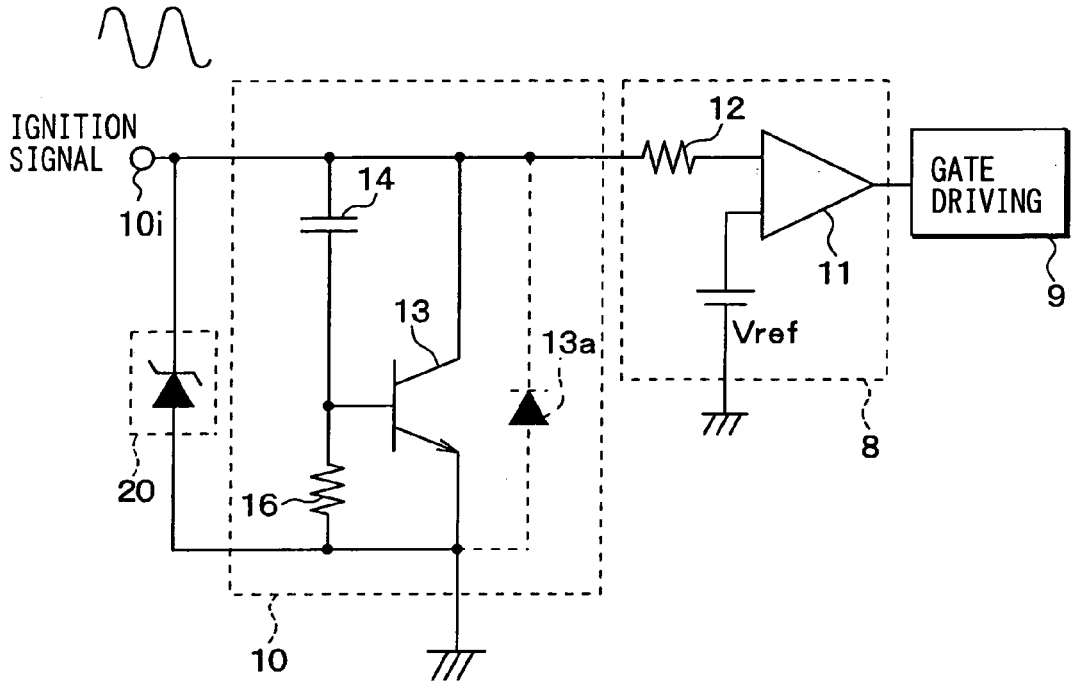
FIG. 6 is a circuit diagram of a protection element and a control IC of the ignition system according to the fourth embodiment of the invention.

An ignition system 1 for an internal combustion engine according to the fourth embodiment of the invention will be described with reference to FIG. 6. An electro static discharge (ESD) prevention zener diode 20 is added to the protection circuit 10 of the first embodiment to be connected between the input terminal 10*i* and the ground.

Figure 7:
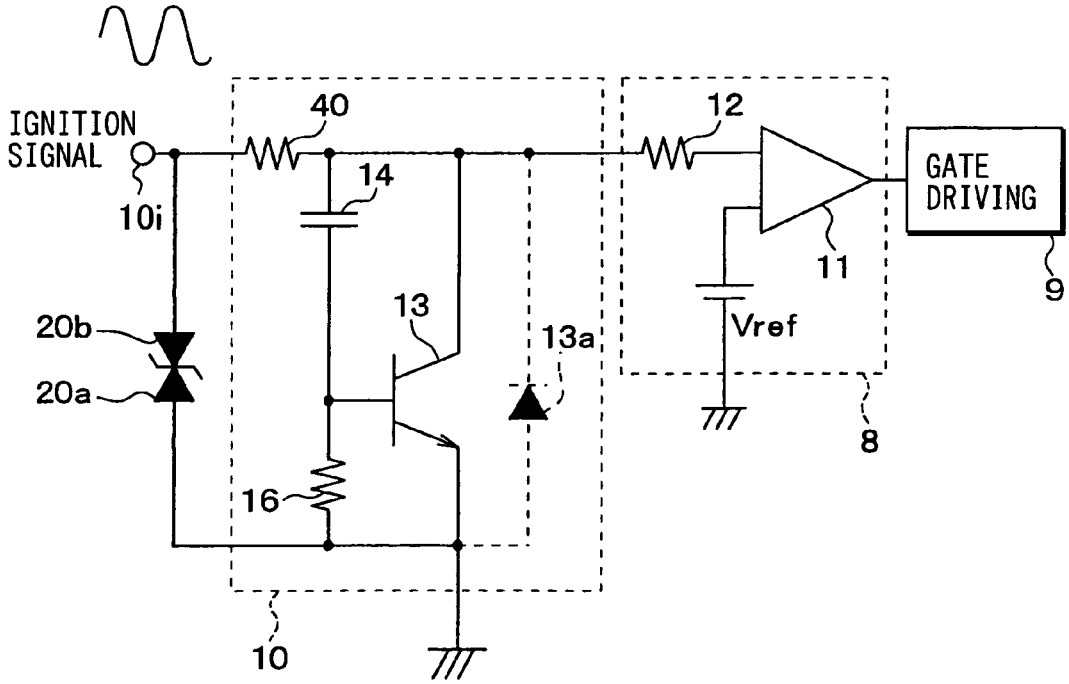
FIG. 7 is a circuit diagram of a protection element and a control IC of the ignition system according to the fifth embodiment of the invention.
Figure 8:
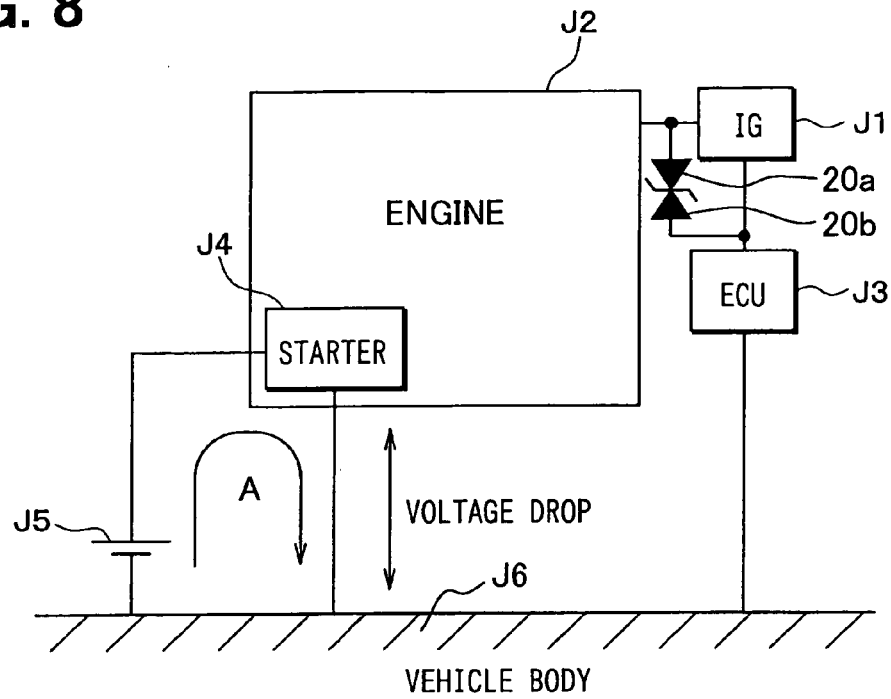
FIG. 8 is a schematic diagram illustrating various components or equipments whose ground terminal is connected to an engine or a vehicle body.

An ignition system 1 for an internal combustion engine according to the fifth embodiment of the invention will be described with reference to FIGS. 7 and 8. A pair of back-to-back connected zener diodes 20*a* and 20*b* is added to the protection circuit 10 of the first embodiment to be connected between the input terminal 10*i* and the ground.

This structure is particularly effective to an ignition system J1 for an internal combustion engine J2 that has a plurality of ignition coils, each of which is directly mounted on one of spark plugs. In this case, the ground terminal of the ignition system J1 is connected to the engine J2 whose potential level is different from a potential level of a vehicle body J6 to which the ground terminal of an engine ECU J3 is connected. Because, a starter J4, which is powered by a battery J5 whose negative terminal is connected to the vehicle body J6, is grounded to the engine J2 as shown in FIG. 8. That is, when the starter J4 is powered by the battery J5 to drive the engine J4, a large amount of starting current flows as indicated by curve A to form a voltage drop.

The pair of zener diodes 20*a* and 20*b* blocks current caused by the voltage drop.

Figure 9:
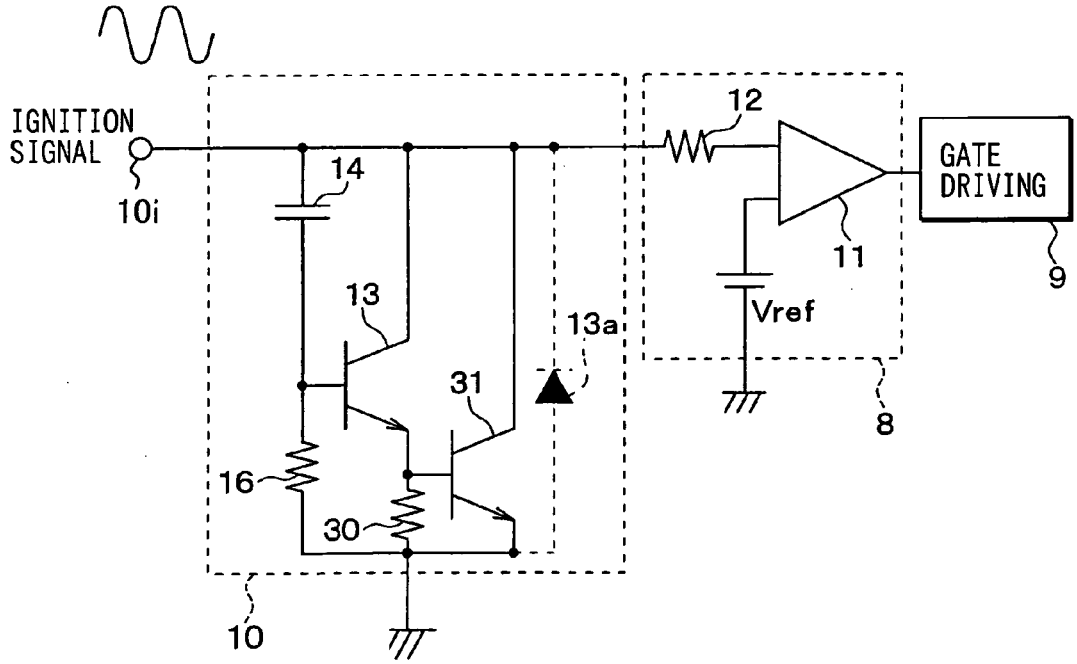
FIG. 9 is a circuit diagram of a protection element and a control IC of the ignition system according to the sixth embodiment of the invention.

An ignition system 1 for an internal combustion engine according to the sixth embodiment of the invention will be described with reference to FIG. 9. Another NPN transistor 31 and a resistor 30 are connected to the NPN transistor 13 of the first embodiment to form a Darlington circuit so as to increase the current gain of the protection circuit 10.

Figure 10:
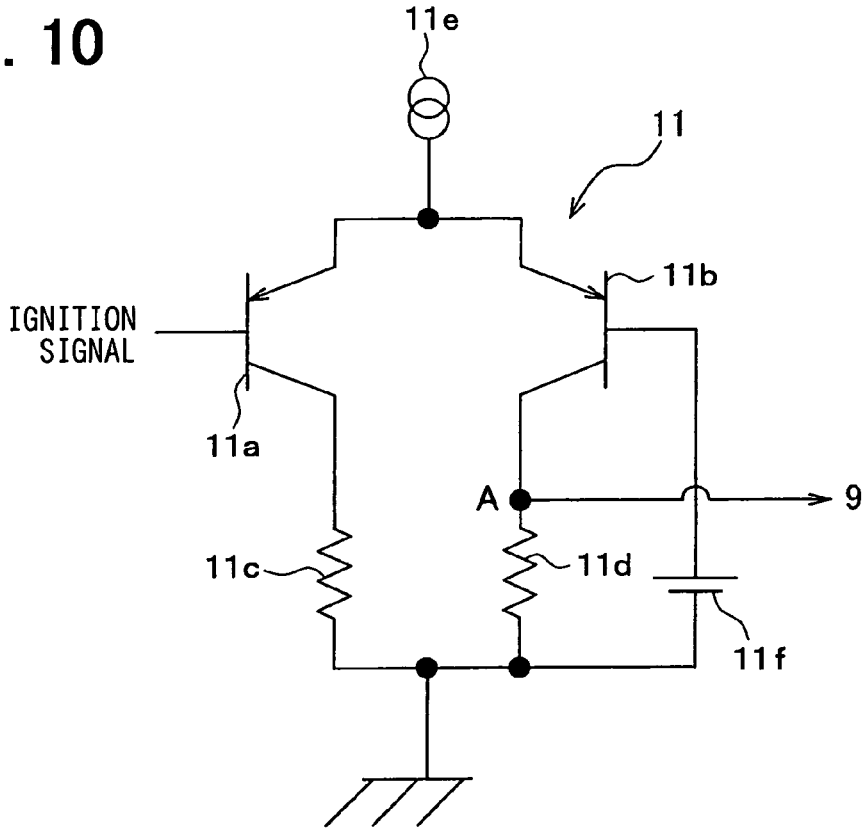
FIG. 10 is a circuit diagram of a protection element and a control IC of the ignition system according to the seventh embodiment of the invention.

An ignition system 1 for an internal combustion engine according to the seventh embodiment of the invention will be described with reference to FIG. 10. The comparator 11 includes a pair of bipolar PNP transistors 11*a*, 11*b*, resistors 11*c*, 11*d*, a constant current source 11*e* and a gate driving power source 11*f*. The PNP transistor 11*a* and the resistor 11*c* are connected in series, and the PNP transistor 11*b* and the resistor 11*d* are connected in series. The PNP transistors 11*a*, 11*b* are parallelly connected to the constant current source 11*e*. The ignition signal is inputted to the base of the transistor 11*a*, and the wave-shaped signal is sent to the gate driving circuit 9 from a junction A of the collector of the transistor 11*b* and the resistor 11*d*. When a low level ignition signal is inputted to the base of the transistor 11*a*, it turns on and the transistor 11*b* turns off. Accordingly, the potential of the junction A becomes low to turn off the IGBT 5. On the other hand the transistor 11*a* turns off and the transistor 11*b* turns on when a high level ignition signal is inputted to the base of the transistor 11*a*. Accordingly, the potential of the junction A becomes high to turn on the IGBT 5.

The bipolar PNP transistors 11*a*, 11*b* switch from the turn-off state to the turn-on state very quickly and switch from the turn-on state to the turn-off state slowly. If high frequency noises are included in the ignition signal to increase the voltage level of the ignition signal, the PNP transistor 11*a* does not turn off due to such a quick and instantaneously increasing and decreasing ignition signal. This prevents an erroneous operation of the ignition system 1 due to high frequency noises.

Figure 11:
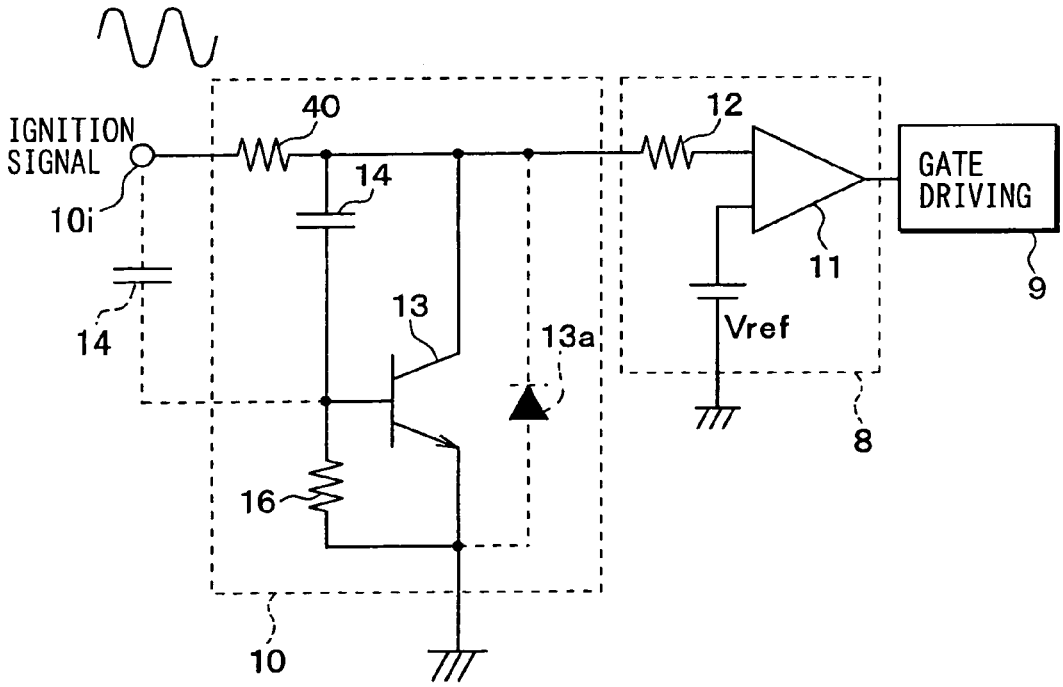
FIG. 11 is a circuit diagram of a protection element and a control IC of the ignition system according to the eighth embodiment of the invention.

An ignition system 1 for an internal combustion engine according to the eighth embodiment of the invention will be described with reference to FIG. 11.

A protection resistor 40 is inserted between the input terminal 10*i* and the positive terminal of the capacitor 14 of the protection circuit 10 according to the first embodiment. If a radio noise comes to the input terminal 10*i*, the radio noise voltage drops when it passes the protection resistor 40. That is, if the radio noise comes to the control IC 3 while the level of the ignition signal is low, the protection resistor 40 keeps the noise voltage to be lower than the threshold level Vref of the comparator 11. The capacitor 14 may be connected between the input terminal 10*i* and the base of the NPN transistor 13.

An ignition system 1 for an internal combustion engine according to the ninth embodiment of the invention will be described with reference to FIG. 12.

Figure 12:
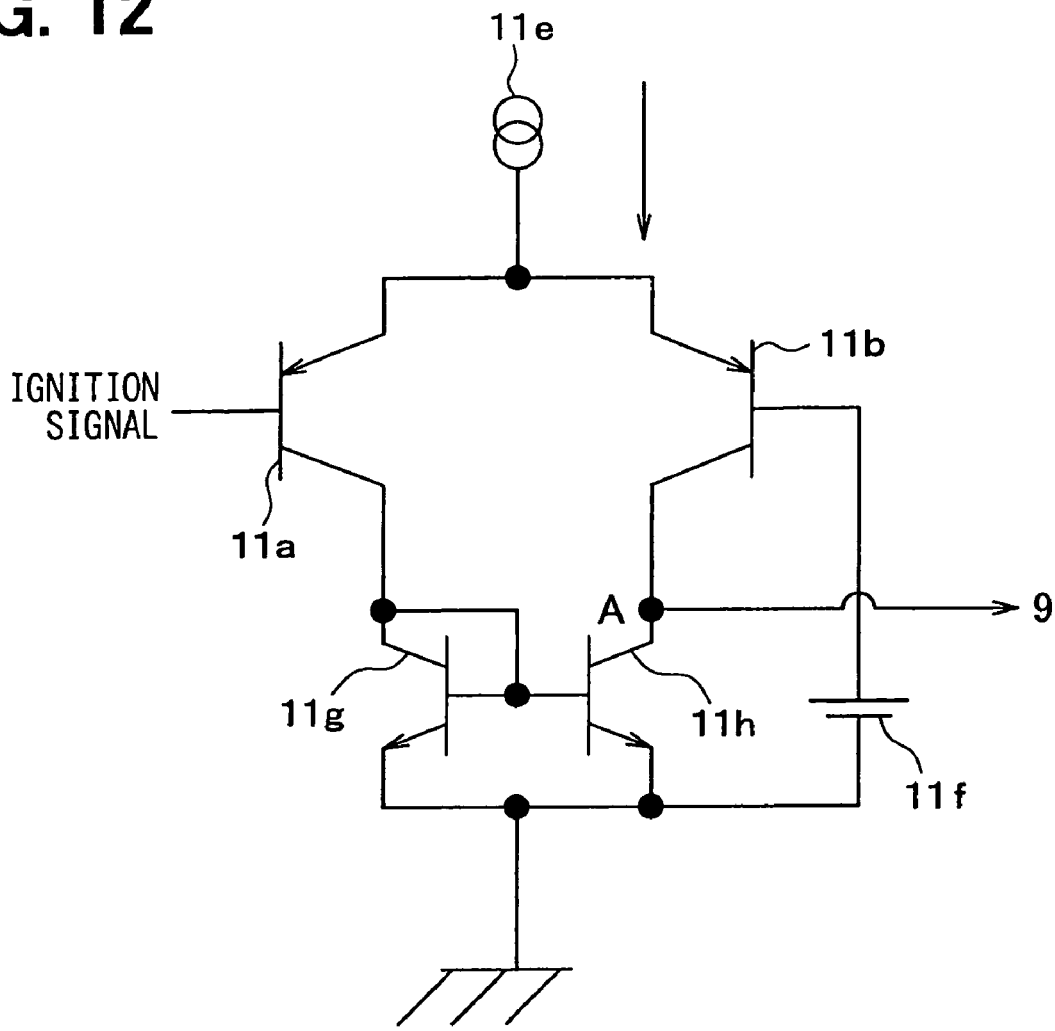
FIG. 12 is a circuit diagram of a protection element and a control IC of the ignition system according to the ninth embodiment of the invention.

The comparator 11 of the seventh embodiment, which includes resistors 11*c*, 11*d*, may be replaced with another comparator shown in FIG. 12. This comparator includes a current mirror circuit of a pair of NPN transistors 11*g*, 11*h* instead of the resistors 11*c*, 11*d*.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. An ignition system for an internal combustion engine to be connected to an ignition coil and a circuit for providing an ignition signal, said ignition system comprising:

a switch circuit connected to the ignition coil to switch on or off current supplied to the ignition coil;

a control circuit, having an input terminal connected to said circuit for providing the ignition signal, for providing a control signal for controlling said switch circuit based on the ignition signal;

a protection circuit including an input terminal that receives the ignition signal from the circuit for providing the ignition signal, a capacitor, a first NPN transistor having a collector connected to the input terminal of said protection circuit and the input terminal of said control circuit, an emitter connected to a ground, a base connected to the input terminal of said protection circuit via said capacitor and a parasitic diode between the collector and the emitter, wherein a prescribed capacitance is formed between the base and the collector of said first NPN transistor.

2. The ignition system as claimed in claim 1, wherein said prescribed capacitance is formed by a capacitor connected between the base and the collector of said first NPN transistor.

3. The ignition system as claimed in claim 1, wherein said prescribed capacitance is formed at a junction of a zener diode that has an anode connected to the base and a cathode connected to the collector of said first NPN transistor.

4. The ignition system as claimed in claim 1, wherein said capacitance is a parasitic capacitance formed between the base and the collector of said first NPN transistor.

5. The ignition system as claimed in claim 1 further comprising an ESD prevention element connected between the input terminal and a ground.

6. The ignition system as claimed in claim 5, wherein said ESD prevention element comprises a pair of zener diodes connected back-to-back each other.

7. The ignition system as claimed in claim 1, wherein said control circuit includes a wave-form shaping circuit for shaping the ignition signal and a gate driving circuit for providing a driving signal from the signal shaped by the wave-form shaping circuit.

8. The ignition system as claimed in claim 1 further comprising a protection resistor connected between said input terminal of said control circuit and the collector of said first transistor.

9. The ignition system as claimed in claim 7, wherein said wave-form shaping circuit comprises a comparator, having an input terminal connected to the input terminal of said control circuit and an output terminal connected to said gate driving circuit, for comparing voltage of the input terminal with a reference voltage.

10. The ignition system as claimed in claim 9, wherein said control circuit further comprising a protection resistor connected between the input terminal of said control circuit and the collector of said first NPN transistor, wherein said protection resistor has a resistance to keep noise voltage to be lower than said reference voltage.

11. An ignition system for an internal combustion engine to be connected to an ignition coil and a circuit for providing an ignition signal, said ignition system comprising:

a switch circuit connected to the ignition coil to switch on or off current supplied to the ignition coil;

a control circuit, having an input terminal connected to said circuit for providing the ignition signal, for providing a control signal for controlling said switch circuit based on the ignition signal; and a protection circuit including an input terminal that receives the ignition signal from the circuit for providing the ignition signal, a capacitor, a first NPN transistor having a collector connected to the input terminal of said protection circuit and the input terminal of said control circuit, an emitter, a base connected to the input terminal of said protection circuit via said capacitor and a parasitic diode between the collector and the emitter and a second NPN transistor having a base connected to the emitter of the first NPN transistor, a collector connected to the input terminal of said protection circuit, thereby forming a Darlington circuit so as to increase the current gain of said protection circuit, wherein a prescribed capacitance is formed between the base and the collector of said first NPN transistor.

12. An ignition system for an internal combustion engine to be connected to an ignition coil and a circuit for providing an ignition signal, said ignition system comprising:

an integrated protection circuit including an input terminal connected to the circuit for providing an ignition signal to receive the ignition signal, a capacitor, an NPN transistor having a collector connected to the input terminal, an emitter connected to a ground and a base connected to the input terminal of said protection circuit via said capacitor, said NPN transistor being arranged to have a prescribed capacitance for passing a portion of extraneous electric surges between said base and collector and a parasitic diode between said collector and the emitter;

a control circuit, having an input terminal connected to the collector of said NPN transistor of said protection circuit, for providing a control signal based on the ignition signal inputted thereto via said protection circuit; and a switch circuit having an input terminal connected to said control circuit and an output terminal connected to the ignition coil to switch on or off current supplied to the ignition coil.

13. An ignition system for an internal combustion engine to be connected between an ignition coil and a circuit for providing an ignition signal, said ignition system comprising:

a protection circuit integrated into a semiconductor chip to include an input terminal connected to the circuit for providing the ignition signal to receive the ignition signal, a bias resistor, a capacitor and an NPN transistor having a collector connected to said input terminal, an emitter connected to a ground and a base connected to the input terminal of said protection circuit via said capacitor and the ground via the bias resistor, a control circuit, having an input terminal connected to the collector of said NPN transistor of said protection circuit, for providing a control signal based on the ignition signal inputted thereto; and a switch circuit having an input terminal connected to said control circuit and an output terminal connected to the ignition coil to switch on or off current supplied to the ignition coil;

wherein said NPN transistor is arranged to have a parasitic diode between said collector and the emitter and a prescribed capacitance for passing a portion of extraneous electric surges between said base and collector.

* * * * *